US005228148A

United States Patent [19]

Weir

[11] Patent Number: 5,228,148

[45] Date of Patent: Jul. 20, 1993

[54] COMBINATION SWIMMING POOL WITH WALL SEAT MODULE

[75] Inventor: Donald H. Weir, York, Pa.

[73] Assignee: Fox Pool Corporation, York, Pa.

[21] Appl. No.: 869,737

[22] Filed: Apr. 10, 1992

[51] Int. Cl.[5] ..... E04H 3/16; E04H 3/18

[52] U.S. Cl. ..... 4/496; 4/493; 4/506

[58] Field of Search ..... 4/496, 506, 488, 511, 4/578.1, 493; 52/478

[56] References Cited

U.S. PATENT DOCUMENTS

| | | | |
|---|---|---|---|
| D. 251,201 | 2/1979 | Mathis | 4/488 X |
| D. 254,572 | 3/1980 | Reineman | 4/488 X |
| 1,193,862 | 8/1916 | Booraem | 4/511 |
| 3,837,016 | 9/1974 | Schindler et al. . | |
| 3,952,338 | 4/1976 | Troxclair . | |
| 4,052,757 | 10/1977 | Dotson . | |
| 4,193,143 | 3/1980 | De Carvalho Vianna | 4/490 |
| 4,238,859 | 12/1980 | Badon . | |
| 4,371,003 | 2/1983 | Goguen . | |
| 4,466,141 | 8/1984 | Starkey | 4/488 |
| 4,468,822 | 9/1984 | McKay . | |
| 4,552,658 | 11/1985 | Adcock et al. | 4/488 |
| 4,642,822 | 2/1987 | Tvengsberg | 4/506 X |
| 4,661,247 | 4/1987 | Weir et al. | 4/506 X |
| 4,837,869 | 6/1989 | Simmon . | |
| 4,930,168 | 6/1990 | Ferlise . | |

OTHER PUBLICATIONS

Tallman One Piece Fiberglass Pools—Pool & Spa News, Leisure Publications, Inc., Los Angeles, Calif.; May 4, 1992; p. 97.

*Primary Examiner*—Daniel M. Yasich

*Attorney, Agent, or Firm*—Arthur J. Plantamura

[57] ABSTRACT

A modular seat unit to be incorporated into the perimeter wall of a swimming pool is provided. The modular seat is devised to afford a purchaser the option of incorporating the unit into a swimming pool by removing one or more modular wall panels which forming the perimeter of the swimming pool and substituting therefor and securing the seat unit into position in place of the omitted vertical wall panel or panels thereby integrating the seat into the perimeter of the swimming pool. The seat unit is provided with a console accessible to the seat occupant to locate controls such as for water flow from the swimming pool supply into the seat recess. The seating area is devised to include hydrotherapy air jets to produce therapeutic water turbulence. An adapter to hold the pole of an umbrella to shelter the seat occupant from the sun's rays and to function as a safety guard is also provided in the horizontal surface of the seat module. The construction provides a seat for an occupant to rest in the pool. The seating does not protrude above the level of the deck or beyond the plane of the vertical wall and presents no protruding obstruction within the pool. The seat module minimizes the inventory of components which a swimming pool supplier of modular pools maintains for the expeditious construction of a pool with various attractive features.

18 Claims, 3 Drawing Sheets

COMBINATION SWIMMING POOL WITH WALL SEAT MODULE

The invention relates to a swimming pool which incorporates a seating element that is recessed within the vertical pool wall and faces toward the interior of the pool. The invention has particular application to swimming pools formed from a plurality of contiguously joined modular wall panels and comprises a construction which, by minimal substitution of modular parts, permits the the optional inclusion within the wall of the swimming pool of a convenient and desirable seating arrangement. More particularly, the invention relates to a swimming pool construction wherein a segment of the modular swimming pool wall may be substituted with an optional modular unit comprising a seating arrangement to accommodate a swimmer with a seat while still in the swimming pool.

BACKGROUND OF THE INVENTION

The availability of a means to permit a swimmer to rest in a comfortable sitting position in a swimming pool has frequently been sought. While it is of course possible to lower a chair or stool into the swimming pool as a seating means, this is awkward and generally uncomfortable and unsatisfactory and, sometimes, even hazardous. Also, while various schemes devised to afford arrangements adjacent to the pool that include a therapy unit (which may include a seating arrangement) have been proposed such as: placing a therapy pool contiguous or within a swimming pool, including attaching the therapy pool to the wall of the swimming pool with a transition section as disclosed, for example, in U.S. Pat. No. 4,001,899; or depositing a removable partition comprising a therapy pool within the swimming pool as disclosed in U.S. Pat. No. 4,240,165; a need exists for a more simplified, economical, very practical and aesthetically improved combination of swimming pool and conveniently comfortable seating means as provided by the present invention.

SUMMARY OF THE INVENTION

The present invention provides a novel, within-the-pool comfortable contoured seating arrangement. The seat is recessed within the interior vertical wall of the swimming pool. The most basic form of the seat module of the invention comprises a swimming pool in which a seat is integrated into the vertical wall of the swimming pool and includes an improved method for providing a combined arrangement of this kind. In a specific embodiment, the invention provides means to incorporate into the perimeter wall of the swimming pool, the contoured seat module. The seat module is incorporated by replacing one or more of the perimeter standard wall panels with the seat module. The form and design of the modular seat unit of the invention is so constructed and arranged that its inclusion within the swimming pool structure is a convenient highly prefable feature of the swimming pool. Yet it is an option which a swimming pool purchaser is free to choose to incorporate. When it is elected to include the seating unit as a part of the swimming pool, the incorporation thereof is effected by replacing one or more of the standard wall modules of the main swimming pool with the seat module, said seat module being generally of a molded design of one piece and being provided with securing flanges at each side of the seat, said flanges being adapted to be secured to and to mate with the flanges of the contiguous wall panels, in lieu of the displaced wall panel(s).

In an alternative embodiment, where a stairway may not be included in the swimming pool, or in lieu of a conventional stairway, the seat module of the invention may integrate a stair element. Additionally, the seat module preferably includes one or more water jet openings or outlets within the contour of the seat cavity, i.e., hydrotherapy jets, at the back and/or sides of the seat contour, to introduce water preferably pressurized with air flow to produce water turbulence and supply a therapeutic benefits. The seat module includes conveniently accessible, preferably individual controls for a seat occupant to adjust the water jet flow to the seat. The controls for the water and turbulence generating air supply are preferably positioned such as by mounting them on a console contigous to and accessible to the occupant of the seat. The controls may be interlocked with the water flow for the swimming pool and so as to draw from the filter pump, water heater, and the like, facilities already present in the system for the swimming pool. The modular seating unit is also preferably devised to accommodate a removable umbrella. For this purpose the console includes a securing means for the umbrella which is highly advantageous to provide the seat occupant with shelter from the rays of the sun.

It is accordingly an object of the invention to provide a novel combination comprising a seating element which is integrated into the structural wall of a conventional swimming pool.

It is another object of the invention to provide a seating arrangement for pools comprising a modular unit, the integration of which into the interior wall of the swimming pool, is effected by replacing one or more of the modular wall panels with the seat module of the invention.

A further object of the invention is to provide a seating arrangement which incorporates a therapeutic capability of pressurized jets of water and turbulent air flow within the seating recess.

It is another object of this invention to provide a therapeutic functioning comfortably contoured seat of this kind incorporated within the interior wall of a swimming pool, and equipped with controls conveniently accessible to the seat occupant to regulate the flow of turbulent water jets introduced into the seat contour against the body of the seat occupant.

It is a further object of the invention to provide a comfortably contoured lounge type modular seat unit devised to fit within the interior wall of the swimming pool, and wherein the seat opens into the swimming pool so as to be accessible to the user of the swimming pool while the swimmer is still in the pool. The modular seat is integrated into the swimming pool wall structure of a swimming pool that is comprised of discrete modular wall panels by replacing one or more of said wall panels with the seat-containing module of the invention. The seat module of the invention may optionally include an integrated stairway contiguous to the seat such that the seating and stairway may be combined and installed as a single preformed unit within the wall by substituting it for one or more of the discrete conventional wall panels which comprise the perimeter wall of the swimming pool. A related and more particular object of the invention resides in the incorporation into the module of a safety railing for the stairway.

Another object of the invention resides in the provision of a seat module unit within the interior wall of a swimming pool wherein the contoured seat back incorporates therapeutic fluid means feeding water jets into the seat cavity and wherein said seat module is provided with a console to mount the fluid flow controls that are conveniently accessible to the seat occupant.

A further and preferred object of the invention resides in the incorporation in the seat module in conjunction with the seat, of means to accommodate a shelter umbrella within, or contiguous to, the console of the seat module of this kind. A related and more specific object of the invention resides in the utilization of the shelter umbrella and/or other physical barrier, as a safety device to guard against a pool user accidentally falling into the seat opening.

Additional objects, advantages and capabilities afforded by the invention will become apparent from the accompanying drawing and the detailed description which follow:

DETAILED DESCRIPTION OF THE DRAWING

Figure 1:
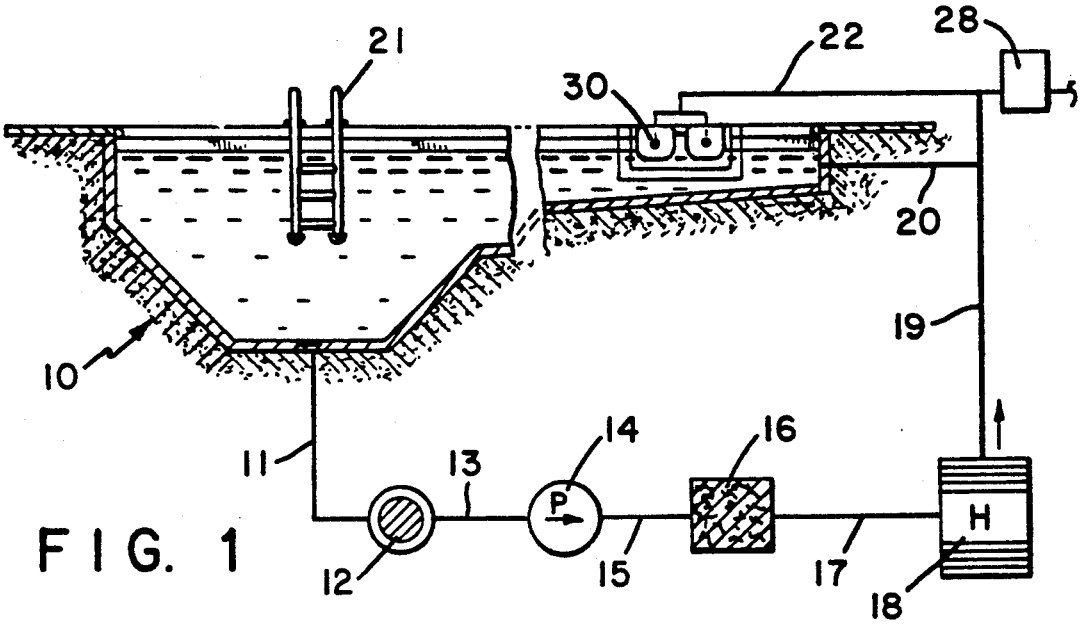
FIG. 1 is a schematic view of the swimming pool in accordance with the invention in which the seating element is illustrated with the wall perimeter of the swimming pool and with detailed functional utilities.

The seating arrangement of the invention, in its preferred embodiment, contemplates the substitution for a wall panel of a swimming pool, formed from a plurality of contiguously joined wall panels, of a seat module. The seat module may comprise one or more seats. Preferably a pair of seats are incorporated in the module which replaces the "standard" wall panel(s). A purchaser of a swimming pool, therefor, for a relatively minor additional expense, may include in the purchase a seating unit which is integrated into the pool wall. In effect the seat module fills the opening in the pool wall perimeter resulting from omitting one or more "standard" modular wall panels and completes the interior perimeter of the swimming pool structure.

The seats of the swimming pool seat module of the invention are recessed within the wall such that the seats do not protrude into the swimming pool substantially beyond the plane formed by the vertical wall of the swimming pool and preferably the seat openings are essentially flush with the plane of the swimming pool wall. The seat module of the invention may be used with any of a variety of standard commercially available swimming pools that are constructed from a plurality of modular wall panels that are joined end-to-end to form the perimeter of the swimming pool including rectangular shape pools and so called free form shaped swimming pools. The seat component of the invention is a convenient feature of modest cost which is attractive for election by the purchaser of a swimming pool for inclusion in the pool. The seat module is readily incorporated into the pool wall by substituting the seat module for one or more of the standard "plain" wall modules. Typical swimming pools of modular construction are those disclosed, for example, in U.S. Pat. Nos. 3,596,296, 4,661,247 and 4,797,957. Generally, pools of this kind include a flexible liner which covers the walls (formed of contiguously secured modular wall panels) and the bottom of the swimming pool, to define a water holding container.

The integration of the seat component of the invention into the wall structure at the shallow end of the swimming pool affords various substantial benefits over installations that lack this feature. The advantage of integrating the seating component into the swimming pool wall in accordance with the invention include:

The ready availability of a seat for the swimmer to rest without the necessity of leaving the swimming pool.

Compactness; no protrusions into the pool.

A relatively inexpensive and simplified means to introduce a therapeutic spa-like benefit in combination with the swimming pool.

Enhancement in the use of the contiguous swimming pool.

Efficiency in the operation of the therapeutic feature which draws on the utilities, e.g., the warm water supply of the swimming pool.

Provides a convenient, attractive, inexpensive inside-the-pool seating accommodation and therapeutic spa benefits.

A conveniently available means for holding an umbrella which shelters the seat occupant from the sun's rays and provides a safety guard (or barrier) against one accidentally falling from the deck area into the seat opening in the deck.

While the recessed seating arrangement of the invention is described in detail with reference to a construction in which the seat is integrated into the wall of at the shallow end of a swimming pool of a rectangular swimming pool, the installation of the seating unit of the invention, by appropriate modification apparent to those skilled in the art of building modular swimming pools of various shapes, may readily be adapted for use with a modular wall panel swimming pools having a variety of shapes. It is to be noted that the seat arrangement of the invention which is recessed within the swimming pool wall provides a uniquely assimilated combination. The seat module is integrated into the structural peripheral wall of the swimming pool and does not result in an obtrusive unsightly appendage or obstruction that protrudes from the wall into the pool. The seating device provided by the invention introduces a seat that is available, directly, and which is at all times accessible for immediate use by a pool occupant. The seat is desirable as a simple, yet important resting accommodation especially for the elderly, and also for making available the benefits of the therapeutic treatment of the kind that is derived from use of the turbulent water expelled against the body of the occupant of the seat. The water expelled from the jets 50 and 52 may be warmed from the swimming pool water heater.

In the construction that produces the integrated seat installation in the pool wall, as contemplated by the present invention, one or more modular wall panels, depending on the size of the wall panels being replaced and/or the width of the seat module, is omitted from the swimming pool perimeter. In place of the omitted wall panel(s), the seat module is installed. For example, where the module comprises a two-seat unit, the seat module may be substituted for a single "standard" wall panel. On the other hand when the module combines a stairway with the seat(s) in a single integrated unit, the combined seat/stair modular unit may be substituted for two "standard" modular wall panels. Side panel portions with connecting flanges formed at the sides of the seat(s) in the module are of a size, i.e., of a width, so that the total width of the seat module including one or more seats and panel portions with flanges, is equal to the total width of the "standard" wall panel(s) of a conventional wall modules that are replaced.

Suitable supplementary support means of a conventional kind (not shown) known to those skilled in the art may be advantageously provided at the points where the pool wall panels are joined and at the back of the seat module to preclude the possibility of distortion of the aligned structure from settling, frost, etc. Suitable support means may comprise any of the various known support systems, and may include, for example, the adaptation of the adjustable support system disclosed in U.S. Pat. No. 4,589,237.

Referring now to the drawing, and more particularly to FIG. 1, a swimming pool with the seating module and a water circulatory system generally of a conventional kind. Additionally, an air generating means 28 to create turbulence and provide a therapeutic "spa" benefit is illustrated schematically. The swimming pool 10 includes a main drain pipe 11 that removes water from the swimming pool through an unfiltered intake. This water from the swimming pool may pass through a strainer 12 that removes large particles and protects the circulation pump 14 which pumps water from the strainer 12 through pipe 13 to filter 16 through pipe 15. Filter 16 removes sediment and other particles not removed by the strainer 12. The water from the filter 16 passes through a pipe 17 to a heater element 18. The heater 18 is a preferred feature and may be any of the available swimming pool heaters, e.g., fuel combustion or solar type or combination of both. The water from the heater 18 passes back to the pool 10 through pipe 19 that is connected to a swimming pool filtered return. A conventional pool ladder is shown at 21. The water circulation system illustrated in FIG. 1 removes water from the bottom of the swimming pool 10 and strains, filters and heats the water and deposits the water back into the system pool 10 as shown. The water from the heater 18 may be in part diverted to feed nozzles for water expelled into the seat cavity, two such seat cavities, 46 and 48, being shown in the module 30 of FIG. 2. Pressurized air furnished by the generator 28 is preferably fed through line 22 using suitable valve means to produce turbulence for therapeutic effect. To produce the turbulence, water passing through line 19 may be mixed with air introduced into line 22 generated by the compressor 28 to yield a therapeutic turbulent water flow at the jet nozzles 50 and 52 formed in the backs 46 and 48, respectively, of seats 32 and 34 of seat module 30. Any suitable number of such jet nozzles being employed. Generally two to four such nozzles per seat cavity are sufficient.

Figure 2:
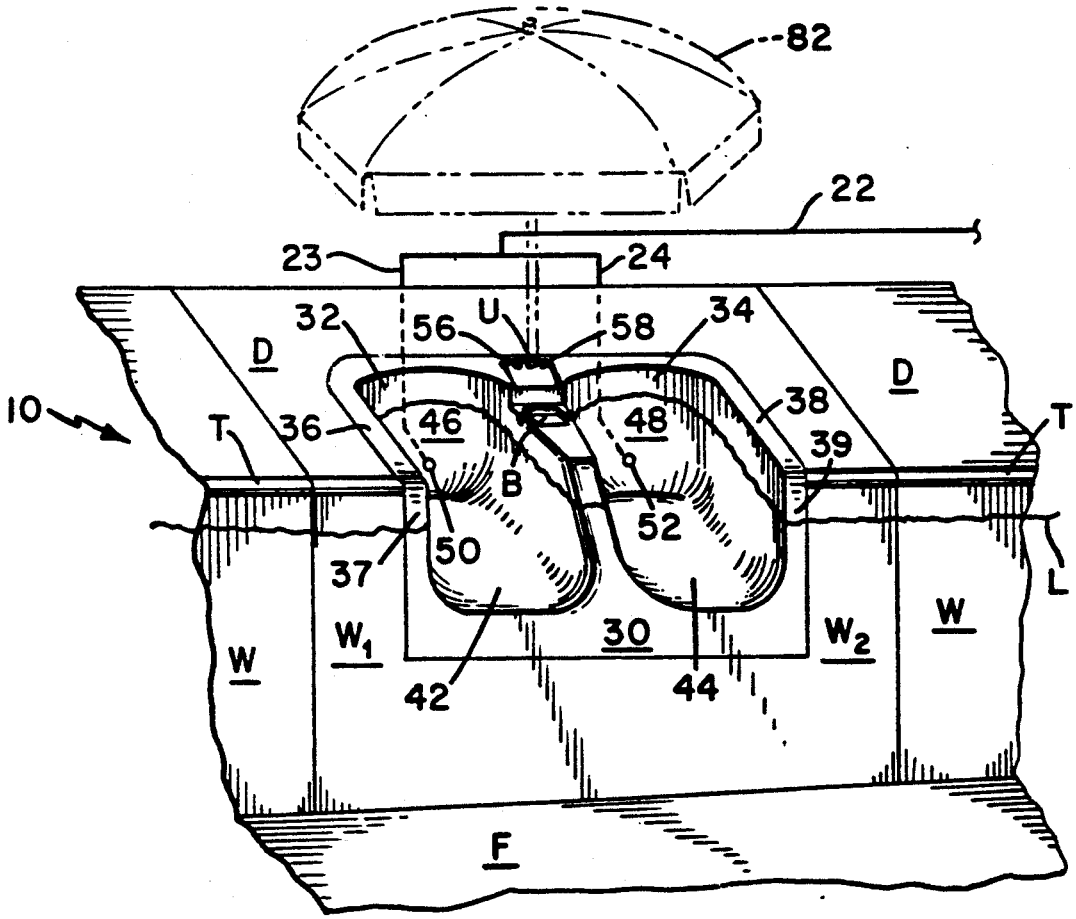
FIG. 2 is a fragmentary perspective view of the pool interior wall seating configuration of the invention shown with a fragment of the contiguous vertical pool wall and deck and illustrating in phantom a shelter umbrella over the seat area.

The fragment of a swimming pool 10 is shown in FIG. 2 comprises portions of the vertical perimeter wall W, a floor F and a deck portion D of a conventional swimming pool such as that illustrated schematically in FIG. 1. When the modular seat unit 30 is incorporated into a swimming pool, as previously mentioned, the modular unit 30 replaces a portion of the pool wall W contiguous the seat unit 30. When the seat module is in position in the swimming pool vertical wall W, it is connected to contiguous panels W of the swimming pool at matching flanges formed at the side of the modular seat unit 30. Side panels W1 and W2, which may be formed as an integral part of the seat module, are sized to accommodate the desired space in the pool wall resulting from removal of one or more "standard" modular wall panels. Additionally, the modular seat unit of the invention may be optionally formed with vertical side portions 37 and 39 that are integrated with flanges, of the seat module 30 and the module 30 may conveniently integrate also panel portions W1 and W2 so that the modular unit which is adopted is furnished with mating flanges that engage the flanges of the "standard" panels of the swimming pool vertical wall and of the horizontal deck portions 36 and 38. The seat module of the invention may be adapted to fit on swimming pools of other shapes, such as an oval or kidney shaped pool and, with respect to the rectangular pools, by replacing the appropriate modular wall panels of the respective swimming pool or by otherwise properly integrating the seat unit by accommodating construction modifications into the wall of the pool such as by the use of pie-shaped adapters or fillers at the ends of the seat module which made with the "standard" contiguous wall and deck modules and thereby conform to the desired curvature of the swimming pool configuration.

Referring further to FIG. 2, when it is desired to incorporate a seat module in the wall of the swimming pool 10, one or two modular wall panels W forming the swimming pool vertical peripheral enclosure walls are omitted. In place of the panels removed, the seat module 30 is connected at mating flanged ends of the modular panels portions W1 and W2 in lieu of the replaced "standard" wall panels to the contiguous vertical wall panels. In other words, the seat module is connected at the left and right mating flanges formed at the edges of seat module portions 37 and 39, respectively, of the seat cavities 32 and 34. The seat opening faces into the swimming pool and is secured in place by bolting or otherwise conventionally securing the edges of the seat module mating flanges with those of the swimming pool wall panels.

If desired the connection may be formed so as to be substantially water tight by suitable caulking or by incorporating a rubber or other yieldable composition gasket where the edges of the wall panel and of the seat flange edges are secured. This sealing connection, as is generally acknowledged in the art, should also be formed so as to have sufficient yield to guard against damage which would otherwise occur from freeze-thaw cycles. To prevent stress and strain at the connection between the side edges of the seat unit and the contiguous swimming pool wall panels and to better support the weight of the seat unit 30 a support system such as that of the aforementioned U.S. Pat. No. 4,589,237 may be adapted.

The seat unit 30 of the invention is provided with an interior seat areas two of which 32 and 34 are shown in FIG. 2 comprising a horizontal seat part 42 and 44 and a vertical side and back portion 46 and 48, respectively, to afford a comfortable contoured reclining seat for pool users. The seat module 30 includes a console portion C which accommodates suitable controls and a securing means for a shelter umbrella. When the seat module, optionally but preferably, includes a source of heated water and/or air jets 50 and 52, the console C includes controls 56 and 58 as well as other desired controls.

As seen, the seat cavities 46 and 48 are immersed in the pool water so that the water level L, when an adult person is resting in the seat of the modular unit that is installed at the shallow end, e.g., at the 3-foot depth of a conventional swimming pool, reaches to the lower chest of the person.

Suitable non-obtrusive holding means are provided in the console C, such as a socket opening U, to accommodate an umbrella to shelter a seat occupant from the rays of the sun. The umbrella holding means, when the umbrella is removed, are recessed slightly below the desk surface. This is desired so as not to interfere with winterizing of the swimming pool. The umbrella also functions as a safety guard against a person accidentally stepping into the seat well formed in the deck D. The console C also affords a convenient place to locate additional add-ons features or elements, such as a recess B used to secure or rest one or more beverage containers.

Figure 3:
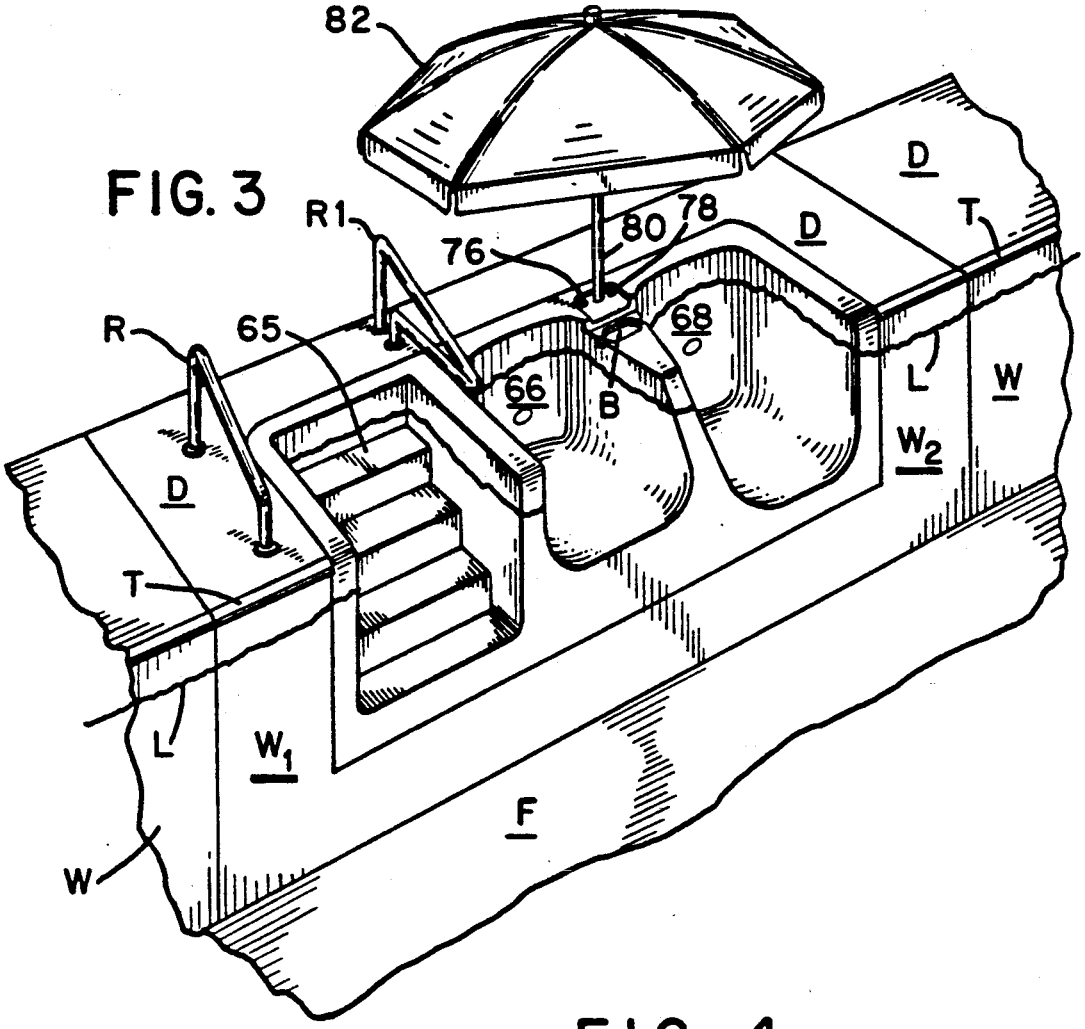
FIG. 3 is an alternative fragmentary view of an alternative embodiment of the seating module of the invention which integrates into the seating module a stairway and also illustrating a shelter umbrella secured in the umbrella holder formed in the console part of the seat module.
Figure 4:
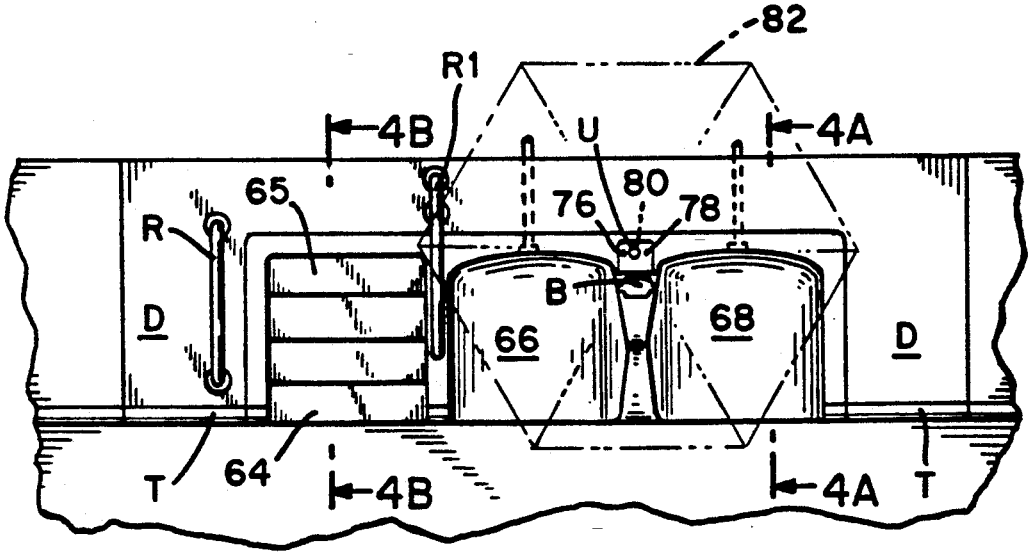
FIG. 4 is a plan view of the embodiment shown in FIG. 3.
Figure 4A:
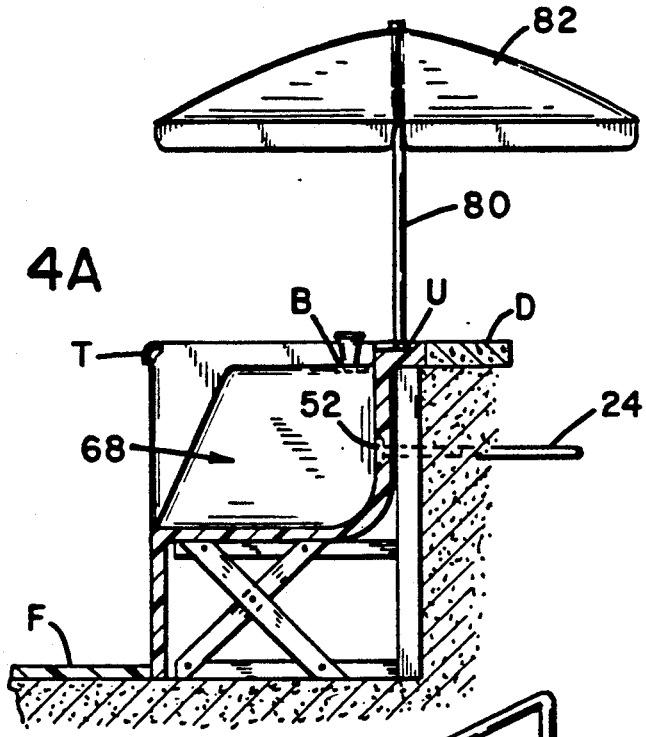
FIG. 4A is an elevational sectional view taken along Line 4A—4A of FIG. 4.
Figure 4B:
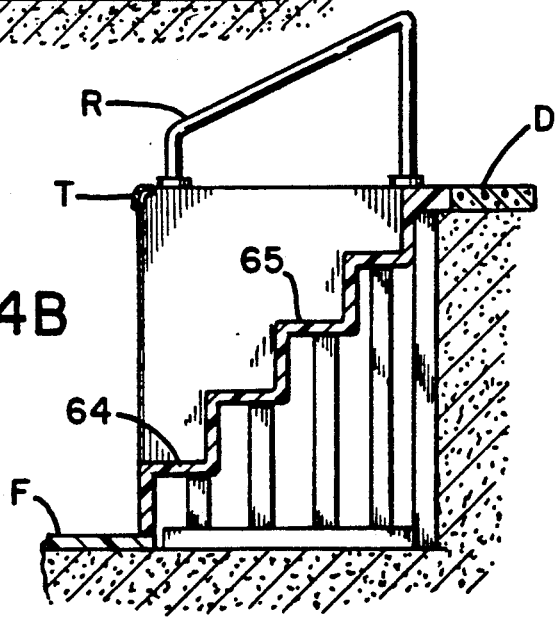
FIG. 4B is an elevational sectional view taken along Line 4B—4B of FIG. 4.
Figure 5:
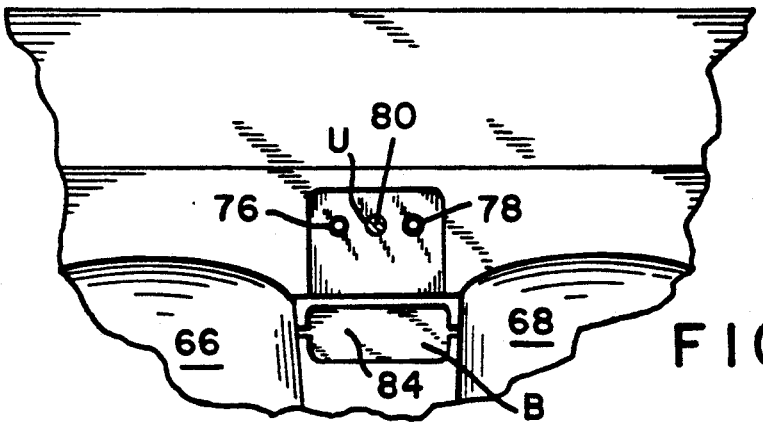
FIG. 5 is an enlarged fragment plan view of the console portions of the seat module.

Referring to the alternative embodiment of FIGS. 3-5, a seat module 60 including a stair portion 64 and a first and second seat portions 66 and 68 respectively is illustrated. A conventional safety railing R is suitably located in the deck D contiguous to the stairs 65. The rail R may be positioned in the deck D contiguous to the location of the seat module of the invention. Alternatively, or in addition, a rail R1 may be incorporated in the seat/stair module of the invention. The rail R1 also functions as a safety guard against an accidental misstep into the seat well formed in the deck. The console C of the unit shown in FIGS. 3-5 is provided with suitable elements, such as the air and water controls 76 and 78 and a holder/adapter U to receive the end of the support pole 80 of an umbrella 82. Preferably the horizontal surface of the seat module when in position in the deck is depressed slightly so that the top of all controls and adapters contained in the console to not extend above the surface of the deck. This arrangement of recessed elements eliminates interference with construction of the swimming pool and with the pool winterizing procedures, i.e., securing a flat cover on the pool deck.

If desired the seats may be made so as to vary in height, i.e., so that a relatively short person, resting in a seat with a higher seat bottom would be nearly at the same height as a relatively taller person resting on a seat having a relatively lower seat bottom as illustrated for example in the paired seats 66 and 68 of FIG. 3.

A conventional coping which provides a smooth transition between the horizontal deck D and the vertical wall W is shown at T in each of FIGS. 2, 3, and 5.

The controls 76 and 78 for the heated water and water/air supply in the console are illustrated in better detail in the enlarged fragmentary plan view of FIG. 5 together with a beverage recess B accommodating two recesses, cup or glass recesses 84 and 85.

Suitable valve means and safely shut off controls for governing water flow quantity, for turbulence generation, for temperature adjustment, and the like, all of which are known and available in the art may be incorporated to service the hot water and air turbulence generating air into the seat recesses. Such controls optionally, may interlock with, and override, the swimming pool controls (not shown) for similar functions attendant to the swimming pool.

While the invention as described in detail and shown in the accompanying drawings present a preferred embodiment, it will be understood that the invention may be modified in various additional details without departing from the spirit of the invention.

What is claimed:

1. A swimming pool formed from a plurality of contiguous modular wall panels joined end-to-end to define a pool enclosure and incorporating a modular occupant seat unit within a vertical wall of the swimming pool and at a shallow end of a swimming pool, said seat unit comprising a module devised to replace one of said modular wall panels and adapted to be joined with said contiguous wall panels, said seat module being provided with an occupant seat with contoured side and back portions and open to the interior of the swimming pool and which when the seat module is secured to the said contiguous wall panels the seats are located below the swimming pool water line and such that the top of the modular seat unit does not extend substantially above the plane formed by a horizontal peripheral deck of the swimming pool, said seat unit being recessed within the wall such that the seat module does not substantially interrupt a vertical plane formed by the swimming pool wall extending across the modular occupant seat unit when the seat unit is positioned within the wall.

2. The swimming pool of claim 1 in which the seat unit includes hydrotherapy water jets flowing into the occupant seat.

3. The swimming pool of claim 1 in which the swimming pool seat module includes two seats.

4. The swimming pool of claim 1 wherein the module incorporates an umbrella which, when the umbrella is in the open position shelters the seat occupant.

5. The swimming pool of claim 1 in which the seat unit comprises a plurality of seats.

6. The swimming pool of claim 5 in which a contiguous stairway is integrally formed within the seat module.

7. The swimming pool of claim 6 in which the hydrotherapy jets utilize the heated water which is diverted to the seat unit from the swimming pool supply.

8. The swimming pool of claim 6 in which the seat unit incorporates hydrotherapy jets supplying said seats and a horizontal console with controls for said hydrotherapy jets positioned between said seats.

9. The swimming pool of claim 8 in which the console is recessed below the level of the plane of the contiguous deck.

10. The swimming pool of claim 5 further containing hydrotherapy jets functionally associated with and for use by an occupant of the seat unit.

11. The swimming pool of claim 1 in which a contiguous stairway is integrally formed within the seat module.

12. The swimming pool of claim 1 in which the horizontal upper surface of the seat module is recessed below the plane of the horizontal of the deck surface.

13. The swimming pool of claim 12 wherein the horizontal upper surface of the seat unit includes an accessory mounting console portion.

14. The swimming pool of claim 13 wherein the seat unit console tapers downward toward the center of the swimming pool.

15. The swimming pool of claim 13 further containing a holding means for a handle of an umbrella to shelter the seat occupant.

16. A method of constructing a modular swimming pool incorporating in a periperal wall of the swimming pool a modular seat comprising:

assembling modular wall panels of swimming pool formed from a plurality of modular wall panels containing mating edges and joined end-to-end to define the pool enclosure;

omitting at least one of the said modular wall panels needed to complete the peripheral vertical wall of the the swimming pool;

providing a seat containing module with edges formed to be joined with the mating edges of contiguous wall panels in lieu of the omitted modular wall panel;

replacing said omitted modular wall panels with the said seat containing module;

forming said seat containing module such as to recess a seat thereof behind a plane of a contiguous vertical wall of the swimming pool when the seat module is attached to the said contiguous wall panels, said seat of the seat module, when the seat module is secured to the contiguous wall panels, being located below the swimming pool water line and such that the top of the seat module does not extend substantially above the plane formed by the horizontal peripheral deck of the swimming pool and beyond a vertical plane formed by the swimming pool wall extending across the modular seat when the seat module is positioned within the wall panels; and securing the edges of said seat module to mating edges of contiguous wall panels.

17. The method of claim 16 wherein the seat module incorporates two seats.

18. The method of claim 17 wherein the seat module incorporates holding means for an umbrella to shelter a seat occupant.

* * * * *